US006053111A

United States Patent [19]

Motley

[11] Patent Number: 6,053,111

[45] **Date of Patent: *Apr. 25, 2000**

[54] SURFACE SAFE RIG ENVIRONMENT DETONATOR

[75] Inventor: Jerry D. Motley, Alba, Tex.

[73] Assignee: Halliburton Energy Services, Inc., Houston, Tex.

[ * ] Notice: This patent issued on a continued prosecution application filed under 37 CFR 1.53(d), and is subject to the twenty year patent term provisions of 35 U.S.C. 154(a)(2).

[21] Appl. No.: 08/685,321

[22] Filed: Jul. 23, 1996

[51] Int. Cl.[7] ..... F42B 3/00

[52] U.S. Cl. ..... 102/313; 102/312; 175/4.54

[58] Field of Search ..... 175/4.54; 102/312, 102/313

[56] References Cited

U.S. PATENT DOCUMENTS

| | | | |
|---|---|---|---|
| 4,084,147 | 4/1978 | Mlyniec et al. | 337/407 |
| 4,306,628 | 12/1981 | Adams, Jr. et al. | 175/4.56 |
| 4,619,320 | 10/1986 | Adynana et al. | 166/65.1 |
| 4,640,354 | 2/1987 | Boisson | 166/250 |
| 5,159,145 | 10/1992 | Carissella et al. | 89/1.15 |
| 5,346,014 | 9/1994 | Ross | 166/297 |
| 5,392,860 | 2/1995 | Ross | 175/4.54 X |

OTHER PUBLICATIONS

"High Temperature Resistant, Fluid Disabled, DF–Safe Electronic Detonator Dynawell 0015 FDE", Technical Data Sheet by Dynamit Nobel, 2 pgs, 1994.

"Safe–T–Shot EFI Initiation System", Technical Data Sheet by Magnavox Electronic Systems Company, 2 pgs, undated.

Schlumberger Wireline & Testing, Technical Data Sheet of "Slapper–Actuated Firing Equipment System", Schlumberger, 4 pgs., 1992.

"Safe Operating System", 5 pg. pamphlet, Teledyne Ryan Aeronautical, 5 pgs. undated.

"Wireline EFI Initiation System", Wayne A. Beck, Teledyne Ryan Aeronautical Selph Ordnance Unit, 9 pgs, undated.

"RISI Technical Topics", Technical Data Sheet of FS–20B Capacitor Discharge Unit, RISI, 3 pgs., Aug. 1993.

"Safe Modular Arming Technique (SMART)", pamphlet, 6 pgs, Western Atlas International, Inc., Apr. 1992.

"Three New Systems That Prevent Firing of Perforating Guns and String Shots On or Near the Surface", SPE 22556, J.V. Carisella, R.B. Cook and J.E. Beardmore, Jr., pp. 1–13, 1991.

*Primary Examiner*—Peter A. Nelson

[57] ABSTRACT

The present invention is an explosive device for use in a subterranean well, the downhole portion of the well being at a higher temperature than the surface, the explosive device comprising an explosive, an electrically conductive circuit capable of supplying electricity that can fire the explosive, and, a thermal switch electrically connected in the circuit, the thermal switch being switchable from open to close as the temperature of the thermal switch is changed from the temperature on the surface to the temperature in the downhole portion, the thermal switch being set such that the explosive cannot be electrically fired until the switch is at the downhole temperature.

The thermal switch may operate in either of two ways. In one embodiment, the thermal switch is connected in series in the electrical circuit, and is open at the surface temperature, thereby acting as a break in the electrical continuity of the circuit and preventing electricity from reaching the explosive. In an alternate embodiment, the thermal switch is connected across the circuit and is closed at the surface temperature, thereby acting as a shunt and preventing electricity in the circuit from reaching the explosive. Once either type of switch is heated sufficiently (as when the tool is run into the hole, and is heated by the higher temperatures downhole), the switch changes position and the explosive device is rendered capable of firing. Either embodiment can be used with a variety of explosive devices and wiring configurations, utilizing a range of explosion initiation devices.

20 Claims, 2 Drawing Sheets

SURFACE SAFE RIG ENVIRONMENT DETONATOR

BACKGROUND OF THE INVENTION

A number of different explosive devices are used in oil and gas well operations. Perforating guns are used to fire shape charges. The firing of the shape charges creates additional surface area in the well, to improve production rates. The shape charges in perforating guns are highly explosive, and extreme caution must be used by personnel handling the guns or charges. Other explosive devices which are used in oil and gas well downhole applications include squibs, setting tools, ignitors, core guns, and chemical cutters.

Many of these explosive devices are electric-fired. That is, a current of electricity is used to initiate the explosion. For the safety of personnel, it is imperative that an electrical current does not reach the explosive device while the device is on the surface.

Electrical currents can be accidentally induced into the wiring circuit of an explosive device in any number of ways. One way is via human error. Other ways include short circuits, stray voltage, welding equipment, static electricity, and RF energies such as helicopter radar, microwave, CB radio, ship-to-shore, and cellular telephones. To prevent an accidental electrical current, it is typical that the entire rig and the surrounding area has to alter its activities. This causes delay and expense, and can be difficult to manage.

Therefore, what is needed is a device and method for preventing electrical currents from accidentally triggering an explosive device while it is on the surface, while still allowing the explosive device to be activated downhole.

SUMMARY OF THE INVENTION

The present invention is an explosive device for use in subterranean wells, the well extending from the surface of the earth to a downhole portion in which the explosive device is desired to be used, the downhole portion of the well being at a higher temperature than the surface, the explosive device comprising an explosive, an electrically conductive circuit capable of supplying electricity that can fire the explosive, and, a thermal switch electrically connected in the circuit, the thermal switch having at least two positions, open and closed, the thermal switch being switchable from one position to the other as the temperature of the thermal switch is changed from the temperature on the surface to the temperature in the downhole portion, the thermal switch being set such that the explosive cannot be electrically fired until the switch is at the downhole temperature.

The thermal switch may operate in either of two ways. In one embodiment, the thermal switch is connected in series in the electrical circuit, and is open at the surface temperature, thereby acting as a break in the electrical continuity of the circuit and preventing electricity from reaching the explosive. Once this type of switch is heated sufficiently (as when the tool is run into the hole, and is heated by the higher temperatures downhole), the switch closes and the explosive device is rendered capable of firing.

In an alternate embodiment, the thermal switch is connected across the circuit and is closed at the surface temperature, thereby acting as a shunt and preventing electricity in the circuit from reaching the explosive. Once this type of switch is heated sufficiently (as when the tool is run into the hole, and is heated by the higher temperatures downhole), the switch opens and the explosive device is rendered capable of firing.

Either embodiment can be used with a variety of different explosive devices and wiring configurations, utilizing a range of explosion initiation devices.

A method of preventing the accidental firing of an explosive device is also disclosed.

DESCRIPTION OF THE PREFERRED EMBODIMENT

Figure 1:
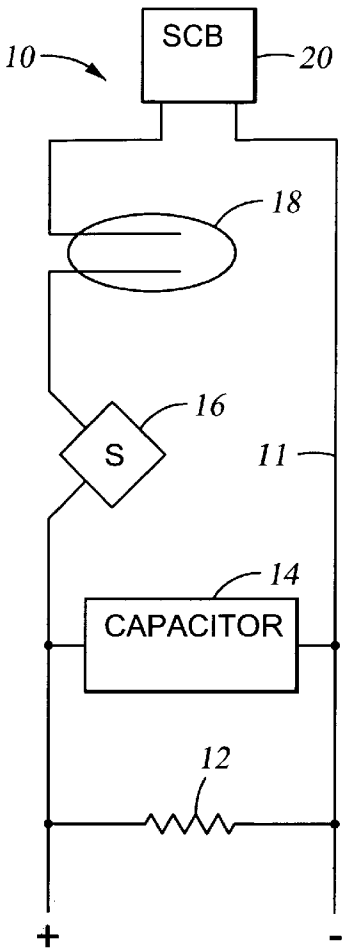
FIG. 1 is a schematic illustration of the electrical circuit of a Rig Environment Detonator (RED™ detonator), utilizing the open-at-surface-temperaturesversion of the inventive concept.

Referring now to FIG. 1, a circuit for a preferred embodiment using a RED™ detonator is shown. The RED™ detonator is a patented Halliburton detonator, which provides some measure of safety while the gun is on the surface. As can be seen, an electrical circuit 10 is shown that consists of conductive wiring 11, a resistor 12, a capacitor 14, a thermal switch 16, a spark gap 18, and a semi-conductor bridge ("SCB") 20, which acts as the initiator for the explosive device. Voltage builds up in the capacitor 14 until it reaches a critical level, a current is then induced, which in turn jumps the spark gap 18, ignites the SCB 20, and thereby sets off the explosive.

The thermal switch shown is designed so that it is open at surface temperature. Typically, the temperatures that can be seen by the thermal switch on the surface can range from −40 to 150 degrees Fahrenheit (° F.). Downhole, the temperatures that the thermal switch will see typically will range from 150 to 375° F. Hence, the thermal switch is selected based on the expected surface and downhole temperatures. In a preferred embodiment, the switch will change positions at a temperature from approximately 150° F to approximately 200° F. In a most preferred embodiment, the switch will change positions at a temperature from approximately 150° F. to approximately 165° F.

The SCB 20 is placed in intimate contact with the explosive and serves as an initiator, causing the explosive to detonate when a sufficient electrical current runs through the SCB to ignite the SCB. The circuit 10 as shown prevents any electrical current from passing across the SCB 20, as long as the thermal switch 16 is open. Once the detonator is run downhole, the switch 20 will heat up. The switch will then close, and the circuit will now be able to pass electrical current through and ignite the SCB 20, which in turn will fire the explosive.

Figure 9:
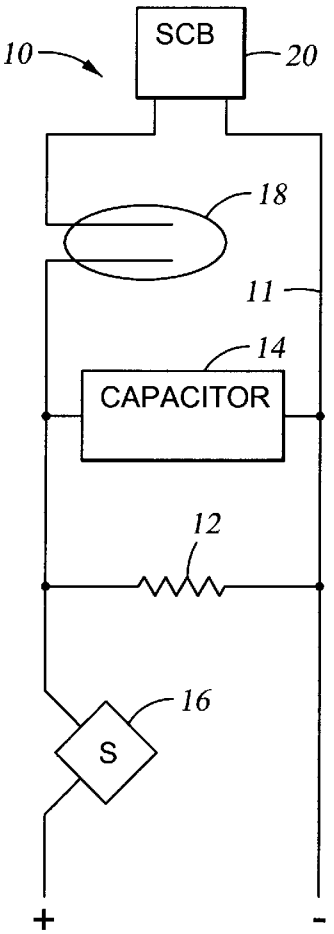
FIG. 9 is a schematic illustration of a RED™ detonator, utilizing the open-at-surface-temperatures version of the inventive concept.

The thermal switch 16 may be placed in a number of different positions in the circuit 10 circuit, as long as it is able to prevent electricity from reaching the SCB at surface temperatures. For example, in FIG. 9, the thermal switch 16 is placed ahead of the resistor 12 and capacitor 14, thereby preventing current from even reaching the capacitor 14.

Figure 2:
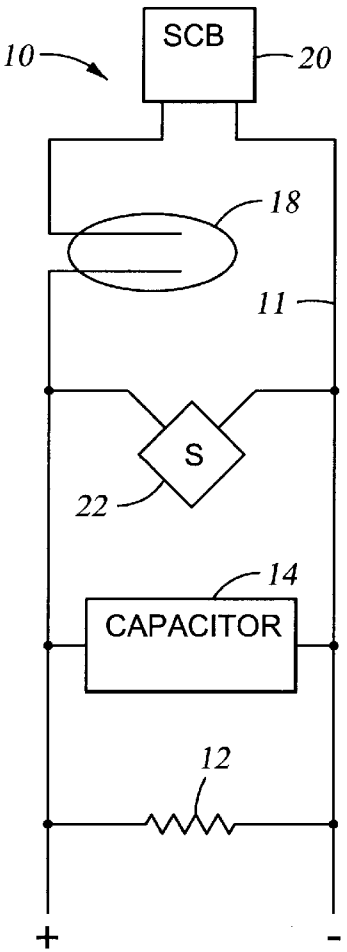
FIG. 2 is a schematic illustration of the electrical circuit of a RED™ detonator, utilizing the closed-at-surface-temperaturesversion of the inventive concept.

Referring now to FIG. 2, an alternate embodiment is disclosed. This embodiment is also a RED™ detonator, but in this case the thermal switch 22 is being used as a shunt, and is closed at surface temperatures. Specifically, the circuit 10 contains conductive wiring 11, a resistor 12, a capacitor 14, a spark gap 16, and an SCB 20. Voltage builds up in the capacitor 14 until it reaches a critical level, a current is then induced, which in turn jumps the spark gap 18, ignites the SCB 20, and thereby sets off the explosive. In this embodiment, the thermal switch 22 is used as a shunt, and crosses the circuit prior to the SCB 20. As the thermal switch 22 is closed at surface temperatures, any current generated will simply cross at the thermal switch, and avoid the SCB 20.

In this embodiment, the thermal switch will open when sufficiently heated, as when it is run down into the wellbore. Once opened, any current of sufficient strength that is induced will then preferentially proceed across the spark gap 18 and through the SCB 20, setting off the explosive.

Figure 10:
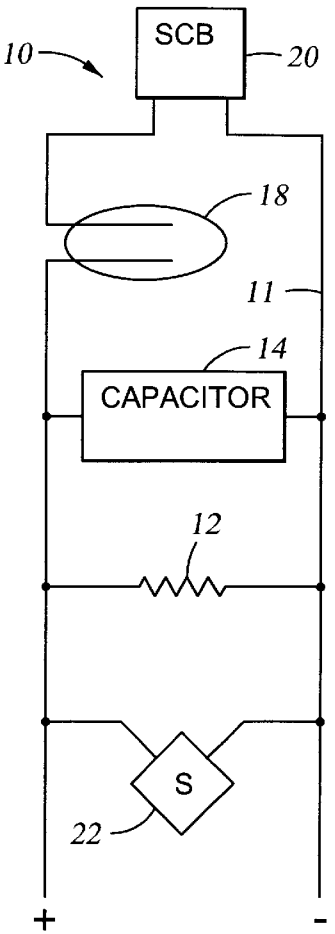
FIG. 10 is a schematic illustration of a RED™ detonator, utilizing the closed-at-surface-temperatures version of the inventive concept.

The thermal switch 22 may be placed in a number of different positions in the circuit, as long as it is able to prevent electricity from reaching the SCB at surface temperatures. For example, in FIG. 10, the thermal switch 22 is placed ahead of the resistor 12 and capacitor 14, thereby preventing current from even reaching the capacitor 14, let alone the SCB 20.

Figure 3:
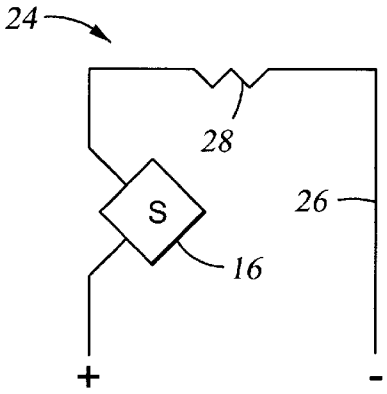
FIG. 3 is a schematic illustration of a one ohm hot wire detonator, utilizing the open-at-surface-temperaturesversion of the inventive concept.

Referring now to FIG. 3, in still another embodiment of the invention, a one ohm hot wire detonator using the inventive concept is shown. Specifically, a circuit 24 comprises electrical wiring 26, a resistive hot wire 28 which heats when current flows through it, and a thermal switch 16 in series with the resistive hot wire 28. The hot wire 28 is placed in intimate contact with the explosive, such that when current flows through the hot wire 28, the hot wire heats up, and when sufficiently hot, ignites the explosive. As in FIG. 1, the thermal switch 16 is open at surface temperatures, thereby preventing current flow to the resistive hot wire 28. The thermal switch 16 is closed at downhole temperatures, allowing current to reach the resistive hot wire 28. Use of such an arrangement prevent any current from flowing through the resistive hot wire 28 at surface temperatures, but does allow current to flow through the circuit at downhole temperatures.

Figure 4:
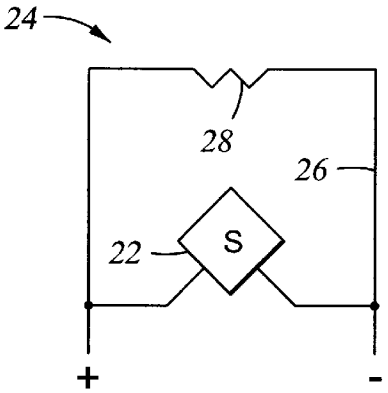
FIG. 4 is a schematic illustration of a one ohm hot wire detonator, utilizing the closed-at-surface-temperaturesversion of the inventive concept.

Referring now to FIG. 4, in still another embodiment of the invention, another one ohm hot wire detonator using the inventive concept is shown. Specifically, a circuit 24 comprises electrical wiring 26, a resistive hot wire 28 which heats when current flows through it, and a thermal switch 22. As in FIG. 2, the switch 22 is closed at surface temperatures thereby providing a shunt to prevent electricity from flowing through the resistive hot wire 28. The thermal switch 22 then is open at downhole temperatures, allowing current to flow through the resistive hot wire 28. Use of such an arrangement prevent any current from flowing through the resistive hot wire 28 at surface temperatures, but does allow current to flow through the resistive hot wire at downhole temperatures.

Figure 5:
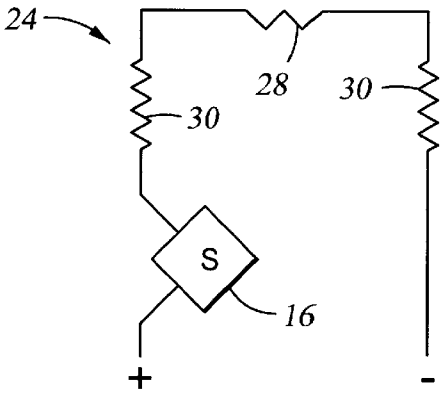
FIG. 5 is a schematic illustration of a 55 ohm resistorized Detonator, utilizing the open-at-surface-temperaturesversion of the inventive concept.

Referring now to FIG. 5, in still another embodiment of the invention, a 55 ohm resistorized hot wire detonator using the inventive concept is shown. This embodiment is basically the same as the one ohm hot wire detonator shown in FIG. 3, except that resistors 30 are included in the circuit to prevent weak currents from flowing through the circuit, and thereby provide some extra protection against an accidental triggering of the detonator. This embodiment works the same as that shown in FIG. 3, with the thermal switch 16 being open at surface temperatures, completely preventing the flow of current through the circuit, and closed at downhole temperatures, thereby allowing a sufficiently strong current to reach the hot wire 28. The thermal switch may be positioned either before or after the resistors.

Figure 6:
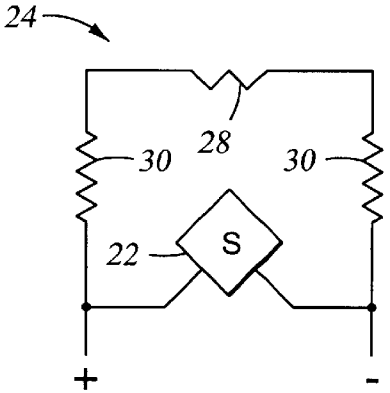
FIG. 6 is a schematic illustration of a 55 ohm resistorized Detonator, utilizing the closed-at-surface-temperaturesversion of the inventive concept.

Referring now to FIG. 6, in still another embodiment of the invention, a 55 ohm resistorized hot wire detonator using the inventive concept is shown. This embodiment is basically the same as the one ohm hot wire detonator shown in FIG. 4, except that resistors 30 are included in the circuit to prevent weak currents from flowing through the circuit, and thereby provide some extra protection against an accidental triggering of the detonator. This embodiment works the same as that shown in FIG. 4, with the thermal switch 22 being closed at surface temperatures, completely preventing the flow of current through the circuit, and open at downhole temperatures, thereby allowing a sufficiently strong current to reach the hot wire 28. Again, the thermal switch may be positioned either before or after the resistors.

Figure 7:
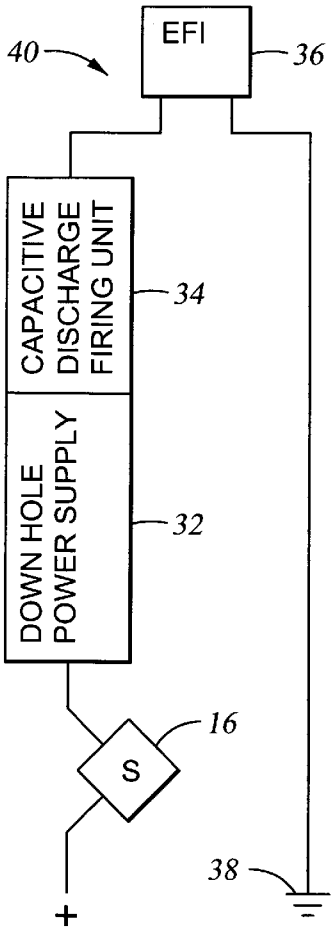
FIG. 7 is a schematic illustration of an Exploding Foil Initiator ("EFI") type detonator, utilizing the open-at-surface-temperaturesversion of the inventive concept.

Referring now to FIG. 7, in another embodiment of the present invention, an exploding foil initiator ("EFI") type detonator is shown. This detonator comprises a circuit 40 comprising the thermal switch 16, a downhole power supply 32, a capacitive discharge firing unit 34, and an EFI 36. When an appropriate electrical signal is sent to the downhole power supply 32, the power supply begins building up a charge in the capacitive discharge firing unit 34 until a sufficiently large charge is present, the charge then being rapidly discharged to ground 38 through the EFI 36. The EFI explodes, initiating the main explosion.

By having the thermal switch 16 positioned in series in the circuit 40 prior to the capacitive discharge firing unit 34, no electrical signal can reach the downhole power supply 32 at surface temperatures, and the initiator cannot fire. As with the other embodiments shown herein, once the detonator is placed downhole, the switch will close, and the detonator can now be fired.

Figure 8:
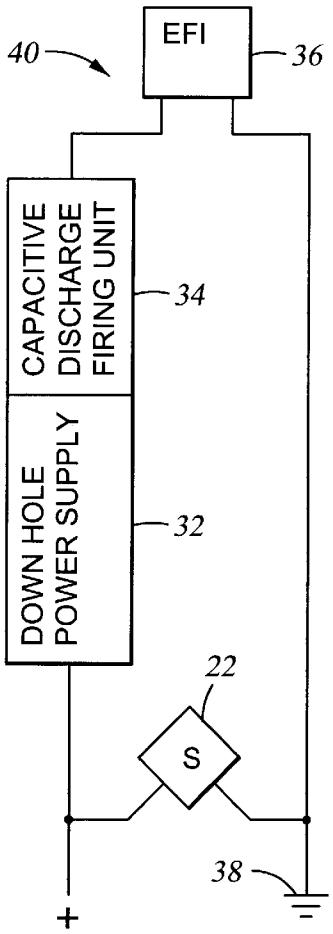
FIG. 8 is a schematic illustration of an EFI type detonator, utilizing the closed-at-surface-temperatures version of the inventive concept.

Referring now to FIG. 8, in another embodiment of the present invention, an EFI type detonator is shown. This detonator comprises a circuit 40 comprising the thermal switch 22, a downhole power supply 32, a capacitive discharge firing unit 34, and an EFI 36. When an appropriate electrical signal is sent to the downhole power supply 32, the power supply begins building up a charge in the capacitive discharge firing unit 34 until a sufficiently large charge is present, the charge then being rapidly discharged to ground 38 through the EFI 36. The EFI explodes, initiating the main explosion.

By having the thermal switch 22 positioned across the circuit 40 prior to the capacitive discharge firing unit 34, no electrical signal can reach the downhole power supply 32 at surface temperatures, and the initiator cannot fire. As with the other embodiments shown herein, once the detonator is placed downhole, the switch will open, and the detonator can now be fired.

An exploding bridge wire may be used in place of the EFI in the embodiments shown in FIGS. 7 and 8.

Preferably, the thermal switch used in these embodiments or any other variation of the invention should be able to cycle from open to close to open numerous times, in case the explosive device has to be removed one or more times from the well prior to firing. When the explosive device is pulled back out of the hole, it takes some time to cool down and reset the switch. Typically, cooling down from 375° F. takes about 15 minutes. As it typically will take significantly longer than this to pull the explosive device completely out of the hole, this is not a problem.

Also, the thermal switch used in any of these embodiments is preferably built into the original system, so that it can be placed as close as possible to the initiator (e.g., the semi-conductor bridge in FIG. 1). However, the inventive concept can also be used with preexisting equipment, by clipping the thermal switch to the leg wire of a standard detonator already assembled. If no other connection is possible, the thermal switch could also be attached in a safety sub.

Therefore, the inventive device and method clearly meet all the objectives laid out above. The foregoing description and drawings of the invention are explanatory and illustrative thereof, and various changes in sizes, shapes, materials, and arrangement of parts, as well as certain details of the illustrated construction, may be made within the scope of the appended claims without departing from the true spirit of the invention. Accordingly, while the present invention has been described herein in detail to its preferred embodiment, it is to be understood that this disclosure is only illustrative and exemplary of the present invention and is made merely for the purposes of providing and enabling disclosure of the invention. The foregoing disclosure is not intended or to be construed to limit the present invention or otherwise to exclude any such embodiments, adaptations, variations, modifications, and equivalent arrangements, the present invention being limited only by the claims appended hereto and the equivalents thereof.

What is claimed is:

1. An explosive device for use in a subterranean well, the well extending from the surface of the earth to a downhole portion in which the explosive device is to be used, the downhole portion being at a higher temperature than the surface, the explosive device comprising:

an explosive;

an electrically conductive capable of supplying electricity that can fire the explosive; and, a thermal switch electrically connected in the circuit, the thermal switch capable of multiple cycling between an open position and a closed position as the temperature of the thermal switch is changed from the temperature on the surface to the temperature in the downhole portion, the thermal switch being set such that the thermal switch is open at the surface temperature and closed at the downhole temperature, thereby permitting the explosive to be electrically fired when the switch is at the downhole temperature.

2. The explosive device of claim 1, wherein the thermal switch is open at the surface temperature, and acts as a break in the electrical continuity of the circuit, thereby preventing electricity from reaching the explosive.

3. The explosive device of claim 2, further comprising:

a semi-conductor bridge electrically connected in series in the circuit and in intimate contact with the explosive;

a capacitor electrically connected across the circuit prior to the semi-conductor bridge;

a resistor electrically connected across the circuit prior to the semi-conductor bridge; and, a spark gap electrically connected in series in the circuit, the spark gap being positioned between the capacitor and the semi-conductor bridge, and wherein the thermal switch is positioned in the circuit such that electrical current cannot reach the semi-conductor bridge through the circuit when the thermal switch is open.

4. The explosive device of claim 2, further comprising a hot wire detonator, the hot wire detonator being in intimate contact with the explosive, and electrically connected in series in the circuit, the thermal switch being positioned in the circuit such that electrical current cannot reach the hot wire detonator through the circuit when the switch is open.

5. The explosive device of claim 4, further comprising a resistor, the resistor being electrically connected in series in the circuit prior to the hot wire detonator, and wherein the thermal switch is positioned in the circuit such that electrical current cannot reach the hot wire detonator through the circuit when the switch is open.

6. The explosive device of claim 2, further comprising:

an exploding foil initiator positioned in intimate contact with the explosive and electrically connected is series in the circuit;

a downhole power supply, electrically connected in series in the circuit;

a capacitive discharge firing unit, electrically connected in series in the circuit, and positioned between the downhole power supply and the exploding foil initiator, and wherein the thermal switch is positioned in the circuit such that electrical current cannot reach the exploding wire initiator through the circuit when the switch is open.

7. The explosive device of claim 2, further comprising:

an exploding bridge wire positioned in intimate contact with the explosive and electrically connected is series in the circuit;

a downhole power supply, electrically connected in series in the circuit;

a capacitive discharge firing unit, electrically connected in series in the circuit, and positioned between the downhole power supply and the exploding bridge wire, and wherein the thermal switch is positioned in the circuit such that electrical current cannot reach the exploding bridge wire through the circuit when the switch is open.

8. The explosive device of claim 1, wherein the thermal switch is closed at the surface temperature and acts as a shunt, preventing electricity in the circuit from reaching the explosive.

9. The explosive device of claim 8, further comprising:

a semi-conductor bridge being in series with the circuit and in intimate contact with the explosive;

a capacitor having a first and a second electrical connection, the capacitor connecting across the circuit at a point prior to the semi-conductor bridge;

a resistor having a first and a second electrical connection, the capacitor connecting across the circuit at a point prior to the semi-conductor bridge and the capacitor; and, a spark gap electrically connected in series in the circuit between the first connection of the capacitor and the first connection of the semi-conductor bridge, and wherein the thermal switch is connected across the circuit such that electrical current cannot reach the semi-conductor bridge through the circuit when the switch is closed.

10. The explosive device of claim 8, further comprising a hot wire detonator, the hot wire detonator being positioned close to the explosive, and electrically connected in series in the circuit, and wherein when the thermal switch is closed it provides a shunt preventing any electricity flowing into the circuit from reaching the hot wire detonator.

11. The explosive device of claim 8, further comprising:

a hot wire detonator having two electrical connections, the hot wire detonator being positioned close to the explosive and electrically connected in series in the circuit; and, two resistors, the resistors being electrically connected in series in the circuit on each side of the hot wire detonator, the thermal switch being connected across the circuit such that electricity flowing in the circuit will be unable to reach the hot wire detonator.

12. The explosive device of claim 8, further comprising:

an exploding foil initiator positioned close to the explosive and electrically connected in series to the circuit;

a downhole power supply, electrically connected in series in the circuit;

a capacitive discharge firing unit, electrically connected in series in the circuit, and positioned between the downhole power supply and the exploding foil initiator, and wherein the thermal switch crosses the circuit such that electrical current cannot reach the exploding foil initiator through the circuit when the switch is closed.

13. The explosive device of claim 8, further comprising:

an exploding bridge wire positioned close to the explosive and electrically connected in series to the circuit;

a downhole power supply, electrically connected in series in the circuit;

a capacitive discharge firing unit, electrically connected in series in the circuit, and positioned between the downhole power supply and the exploding bridge wire, and wherein the thermal switch crosses the circuit such that electrical current cannot reach the exploding bridge wire through the circuit when the switch is closed.

14. The explosive device of claim 2, wherein the thermal switch is open at a temperature below approximately 150 degrees Fahrenheit and is closed at a temperature above approximately 200 degrees Fahrenheit.

15. The explosive device of claim 14, wherein the thermal switch is open at a temperature below approximately 150 degrees Fahrenheit and is closed at a temperature above approximately 165 degrees Fahrenheit.

16. The explosive device of claim 8, wherein the thermal switch is closed at a temperature below approximately 150 degrees Fahrenheit and is open at a temperature above approximately 200 degrees Fahrenheit.

17. The explosive device of claim 16, wherein the thermal switch is closed at a temperature below approximately 150 degrees Fahrenheit and is open at a temperature above approximately 165 degrees Fahrenheit.

18. The explosive device of claim 1, wherein the rest of the circuit is built prior to the addition of the thermal switch to the circuit.

19. The explosive device of claim 1, wherein the thermal switch is built into the circuit at the time the rest of the circuit is built.

20. In a subterranean well having a downhole portion and a surface portion, the downhole portion being at a higher temperature than the surface portion, a method for rendering unfirable at surface temperatures an existing detonator for use in an explosive device designed for use in the subterranean well, while still allowing the explosive device to be firable at downhole temperatures, the method comprising the steps of:

connecting the detonator to the explosive device; and, electrically connecting a thermal switch to the detonator, the thermal switch having at least two positions, open and closed, the thermal switch being switchable from one position to the other as the temperature of the thermal switch is changed from the temperature on the surface to the temperature in the downhole portion, the thermal switch being set such that the detonator cannot be electrically fired until the switch is at the downhole temperature.

* * * * *